US006431363B1

(12) United States Patent
Hacker

(10) Patent No.: US 6,431,363 B1
(45) Date of Patent: Aug. 13, 2002

(54) SHIPPING CARTON AND DISPLAY TRAY

(75) Inventor: Mark G. Hacker, Laguna Hills, CA (US)

(73) Assignee: One Source Industries, Inc., Irvine, CA (US)

( * ) Notice: Subject to any disclaimer, the term of this patent is extended or adjusted under 35 U.S.C. 154(b) by 0 days.

(21) Appl. No.: 09/624,291

(22) Filed: Jul. 24, 2000

(51) Int. Cl.[7] ..... B65D 5/54
(52) U.S. Cl. ..... 206/765; 229/101; 206/486
(58) Field of Search ..... 206/461, 471, 206/499, 764, 765, 774, 486, 583; 229/101, 101.1, 235; 53/467, 472, 473

(56) References Cited

U.S. PATENT DOCUMENTS 3,208,583 A 9/1965 Kamps
3,621,996 A 11/1971 Seyer
3,669,251 A 6/1972 Phillips, Jr.
3,850,363 A * 11/1974 Jacobs ..... 229/235
3,884,348 A * 5/1975 Ross ..... 229/235
3,927,761 A 12/1975 Boyle
4,113,100 A * 9/1978 Soja et al. ..... 206/764
4,363,400 A 12/1982 Lewis
5,098,757 A * 3/1992 Steel ..... 229/235
5,292,003 A * 3/1994 Baghdassarian ..... 206/471
5,979,662 A 11/1999 Green
6,135,289 A * 10/2000 Miller ..... 206/774

* cited by examiner

*Primary Examiner*—Luan K. Bui
(74) *Attorney, Agent, or Firm*—Knobbe, Martens, Olson & Bear, LLP

(57) ABSTRACT

A slotted holder is positioned in a shipping carton having a tear strip extending along its side walls. Product packages having a stiff thin edge fit within the holder and are held upright through the support of the holder. In use, the tear strip is removed enabling the upper portion of the box to be separated with the lower portion and serve as a display tray.

8 Claims, 8 Drawing Sheets

SHIPPING CARTON AND DISPLAY TRAY

BACKGROUND OF THE INVENTION

1. Field of the Invention

The present invention relates to product packages shipped, stored and displayed in cardboard containers.

2. Description of the Related Art

In recent years, efficient and cost-effective packaging techniques have been developed for displaying and preventing theft of small and expensive products, particularly in large retail outlets. Typically, the package has a large stiff configuration with an inner pocket that holds the product the customer desires. Since the package is large, it is much more difficult or awkward for a shoplifter to conceal than the product by itself. The package is sufficiently strong that it cannot be torn or opened manually, thus further discouraging theft.

Such product packaging is provided in different but similar forms. In one form two large sheets of stiff but strong plastic are sealed at their edges, with the product sealed in an interior pocket formed by the sheets. In another form, a single sheet of stiff plastic is sealed at its periphery to a similar sized, large stiff card, with the product pocket formed in the plastic. In a third form, a plastic product compartment is sealed to a single large stiff card. These packages are referred to by various names, such as blister packs or clam shells, but they will be simply referred to herein as product packages.

Such product packages are traditionally placed in cardboard containers having slots that hold the packages in place. A currently marketed box and display employs separate top and bottom pieces. The bottom piece is constructed by folding a fairly large, cumbersome die cut sheet of cardboard into a stand alone display unit. The manufacturer must next construct a top cover, which amounts to folding a sheet of cardboard, absent the bottom surface, into a box. The top cover is placed over and taped to the display unit. Later, the tape is cut, the upper container removed and discarded, and the lower container is left to display the appropriate merchandise. Since the lower piece contains its own outer walls, the top piece fits over the entire display unit and thus results in an unnecessary usage of materials that this creates a double walled lower portion.

With the double wall box, the manufacturer has to print its name or logo on both the outer cover as well as the inner display stand to provide adequate identification. Similarly, UPC codes are printed on both components to maintain identification and product inventory.

There is a need for a simplified box and display construction that maintains the structural integrity of a completed package as well as the convenience of the product package display tray.

SUMMARY OF THE INVENTION

The present invention provides an improved packaging assembly for shipping and displaying product packages. The assembly includes a box having a tear strip extending around the entire vertical wall. The tear strip is easily removed from the box and provides for quick removal of the upper portion of the box to reveal a display tray. The lower unit of the box is used along with a slotted holder to form the display tray. The display tray may also have a perforated section on its front wall that when removed, allows for increased viewing area of the small valuable products sealed in the larger product package.

The holder forming the structural support for the product package is comprised of a unitary cardboard sheet having three parallel fold lines separating it into four smaller panels. The outer two panels form the walls of the holder upon insertion into the box. The two center panels contain a plurality of slots for receiving the product packages. The holder uses the bottom wall of the box as its base.

Advantageously, by printing the desired company name and UPC code on the box below the tear strip, the printing can be viewed both during transit and again on the display tray after the upper portion of the box is removed.

While the tray can accommodate the various packages discussed above, product packages are preferably formed by combining a plastic cover with a strong, stiff card backing. The plastic cover and card backing are joined at their outer edges by a suitable adhesive under heat and pressure. The plastic cover has a product compartment formed in it, and the card and the plastic are joined around the compartment to isolate the product.

DETAILED DESCRIPTION OF THE PREFERRED EMBODIMENT

Figure 1:
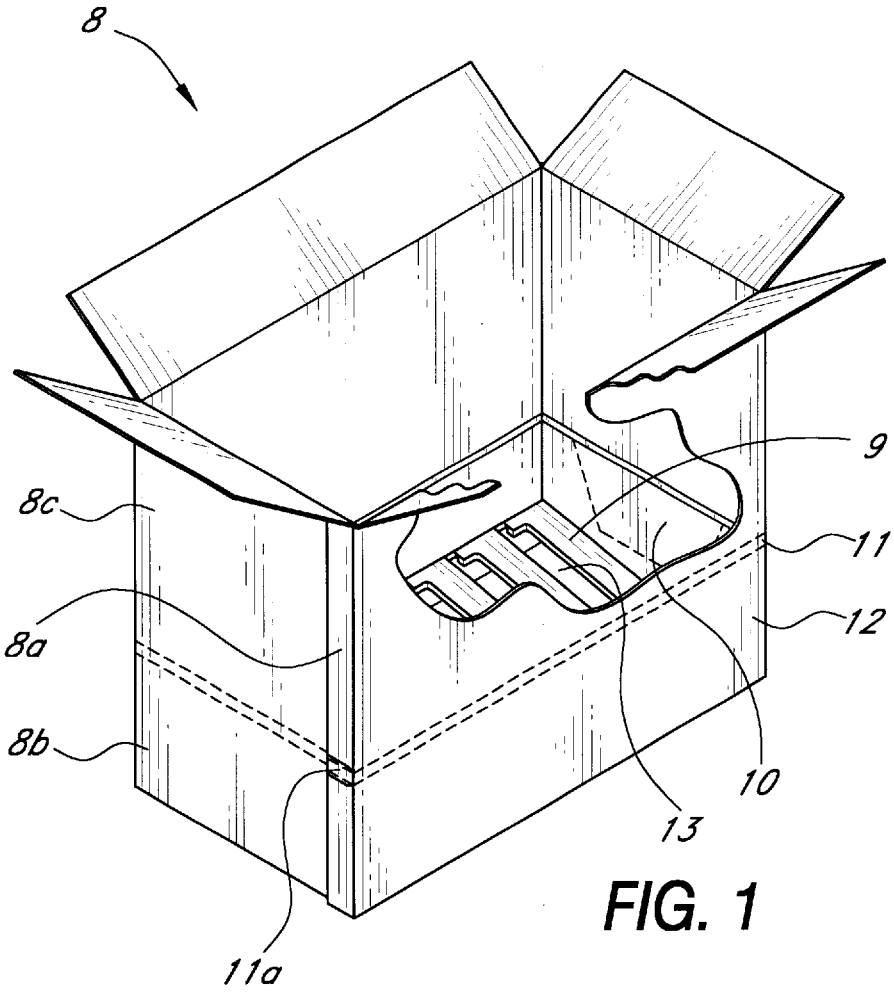
FIG. 1 is a perspective view of the box and tray of the assembled invention with a cutaway view of the interior of the box.
Figure 2:
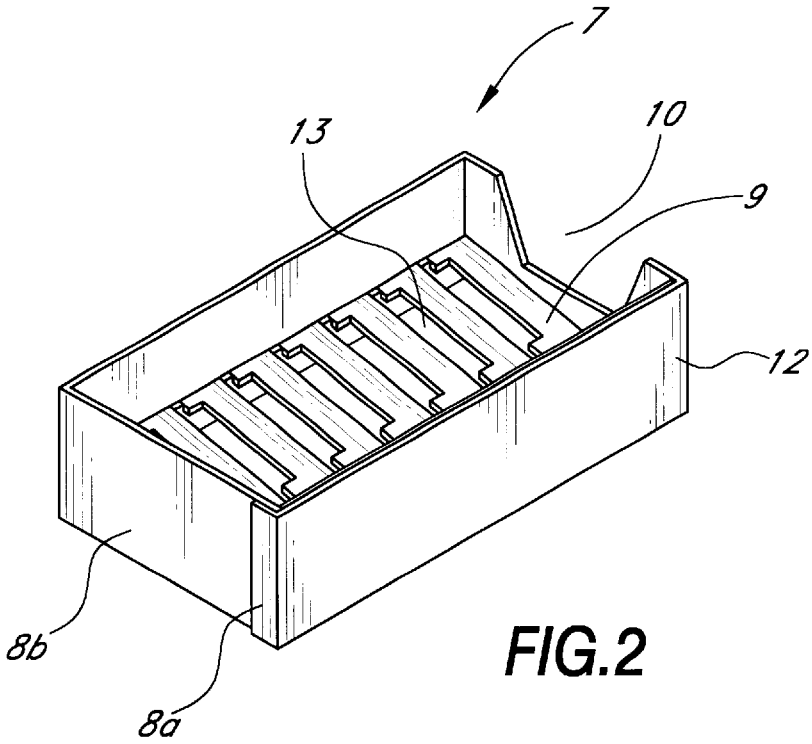
FIG. 2 is a perspective view of the back of the display tray upon removal of both the tear strip, the upper portion of the box, and a front section of the tray.
Figure 3:
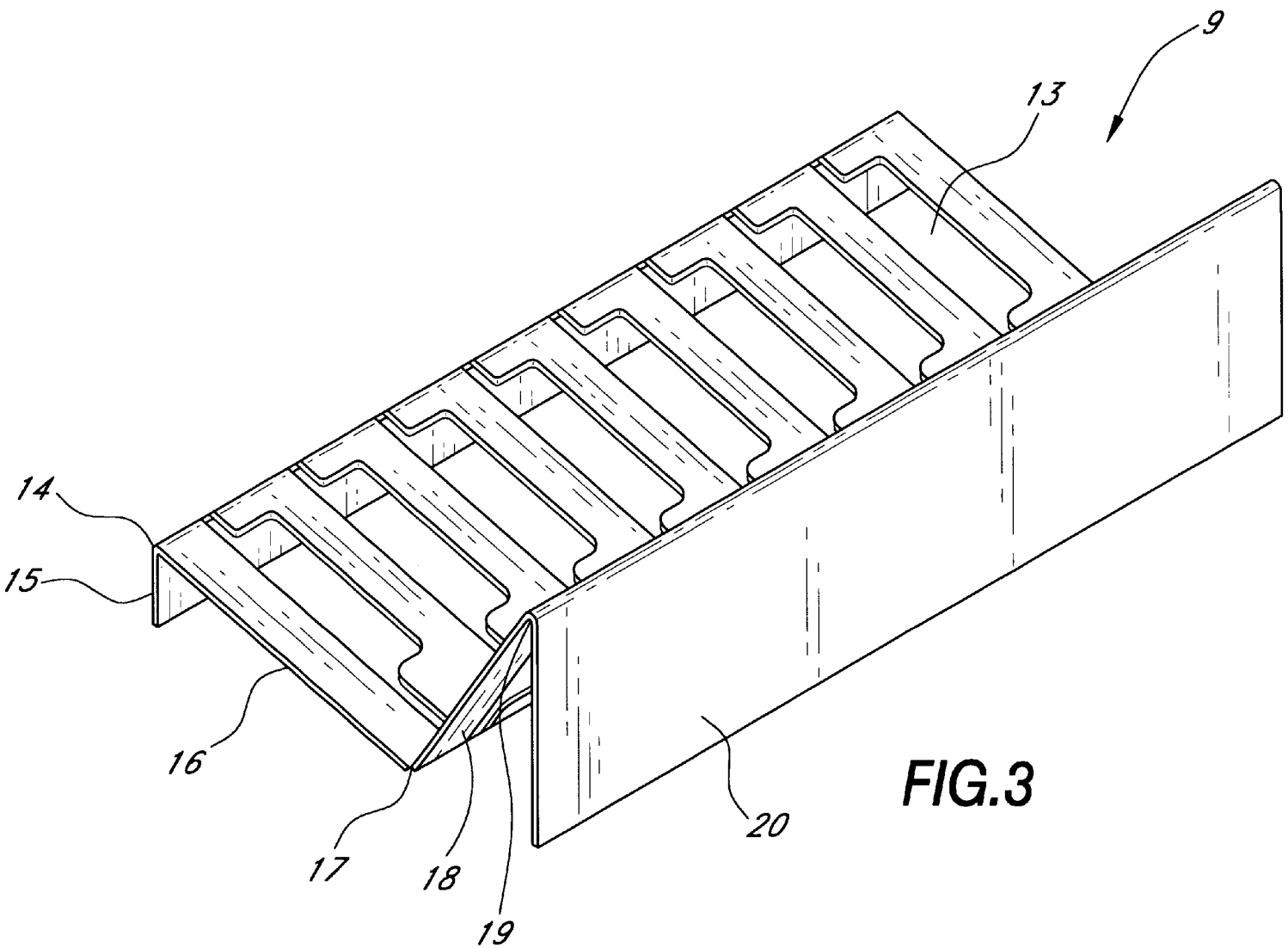
FIG. 3 is a perspective view of the folded holder that is placed within the box.

Referring to FIGS. 1, 2 and 3, the box and display assembly of the invention includes a six-sided box 8 and a slotted insert 9. Both the box and the insert are preferably made of conventional cardboard, but of course other materials can be employed. The box is preferably formed from a flat sheet and folded into the configuration shown with one end of the sheet overlapping the other end as illustrated at **8*a*** on one side corner of the box.

In accordance with the invention, the box is formed with a tear strip 11 that extends completely around the box sidewalls. The tear strip is illustrated in broken lines on the exterior of the box in FIG. 1 to represent perforations. The tear strip 11 is indicated in solid lines on the inside of the box to represent a tear strip formed by a tape containing strong fibers within it. Such a tape would normally be applied to the box when in its flat form. The tape is commercially available from H.B. Fuller Company, Linear Products Division, 417

N.W. 136th St., Vancouver, Wash., 98685, sold under the trademark Open Sesame. The tape and perforations illustrate alternate arrangements. Only one type of tear strip is needed. With either type, a tab 11 a cut in the overlapping area 8*a* of the box can be gripped to enable the tear strip to be manually removed, and thus separate the upper portion of the box from the lower. While two types of tear strips are illustrated, other arrangements may also be employed that maintain the structural integrity of the box before the strip is removed, but can manually be removed when separation is desired.

A panel 10 in a front end wall of the box is defined on its upper edge by the tear strip and is preferably defined on its remaining boundaries by perforations such that the panel may also be readily removed when the tear strip is removed. FIG. 2 illustrates the lower portion 8*b* of the box after the upper portion 8*c* has been removed. As can be seen, it forms a display tray 7 with its slotted insert 9 forming a product package holder.

Figure 5:
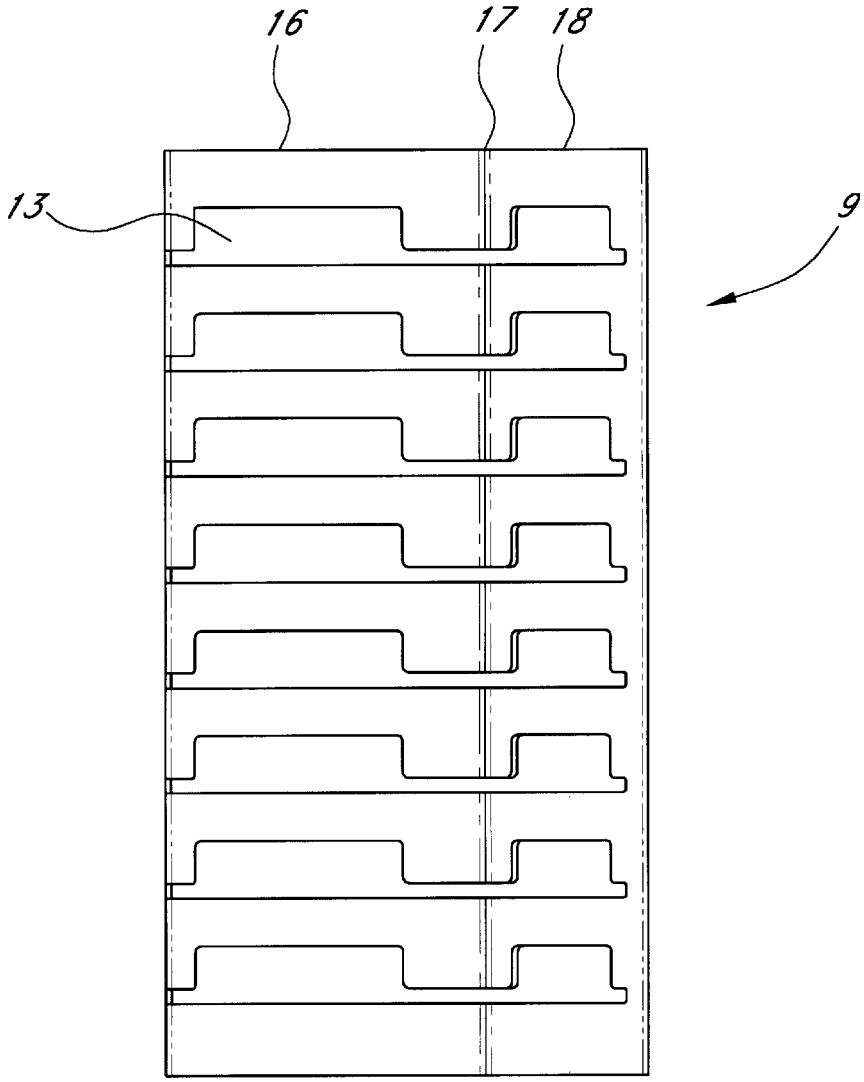
FIG. 5 is a plan view of the folded holder, showing two inner panels of the four-panel sheet.
Figure 4:
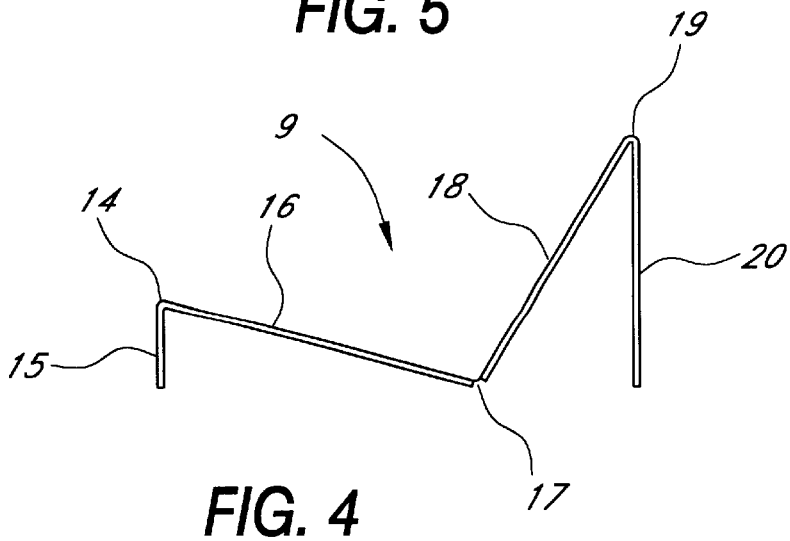
FIG. 4 is an end view of the holder when configured for placement within the storage box.

Referring to FIGS. 3, 4 and 5, the slotted holder 9 is preferably formed as a flat sheet provided with parallel bend lines 14, 17, and 19. Bending the sheet along these lines creates side panels 15 and 20, which function as legs for the holder. The bend lines also create interior panels 16 and 18 in which are cut with a plurality of slots 13. As seen from FIG. 5, the slots extend almost completely across the width of the holder 9. The particular slot shape is determined by the shape of the product package to be positioned in a slot.

As seen from FIG. 4, the support leg 20 is taller than the leg 15 and the panel 18 extends at a more acute angle with respect to the leg 20 than does the panel 16 with respect to the leg 15. As seen from FIGS. 6 and 7, the folded slotted holder 9 is dimensioned to fit within the lower portion 8*b* of the box. As seen best from FIG. 7, the support leg 20 extends almost to the height of the adjacent box or tray wall whereas the support leg 15 extends less than half the height of the adjacent tray sidewall. It can also be seen from FIG. 7 that the bend line 17 in the holder 9 is offset from the center of the tray towards the longer leg 20.

Figure 6:
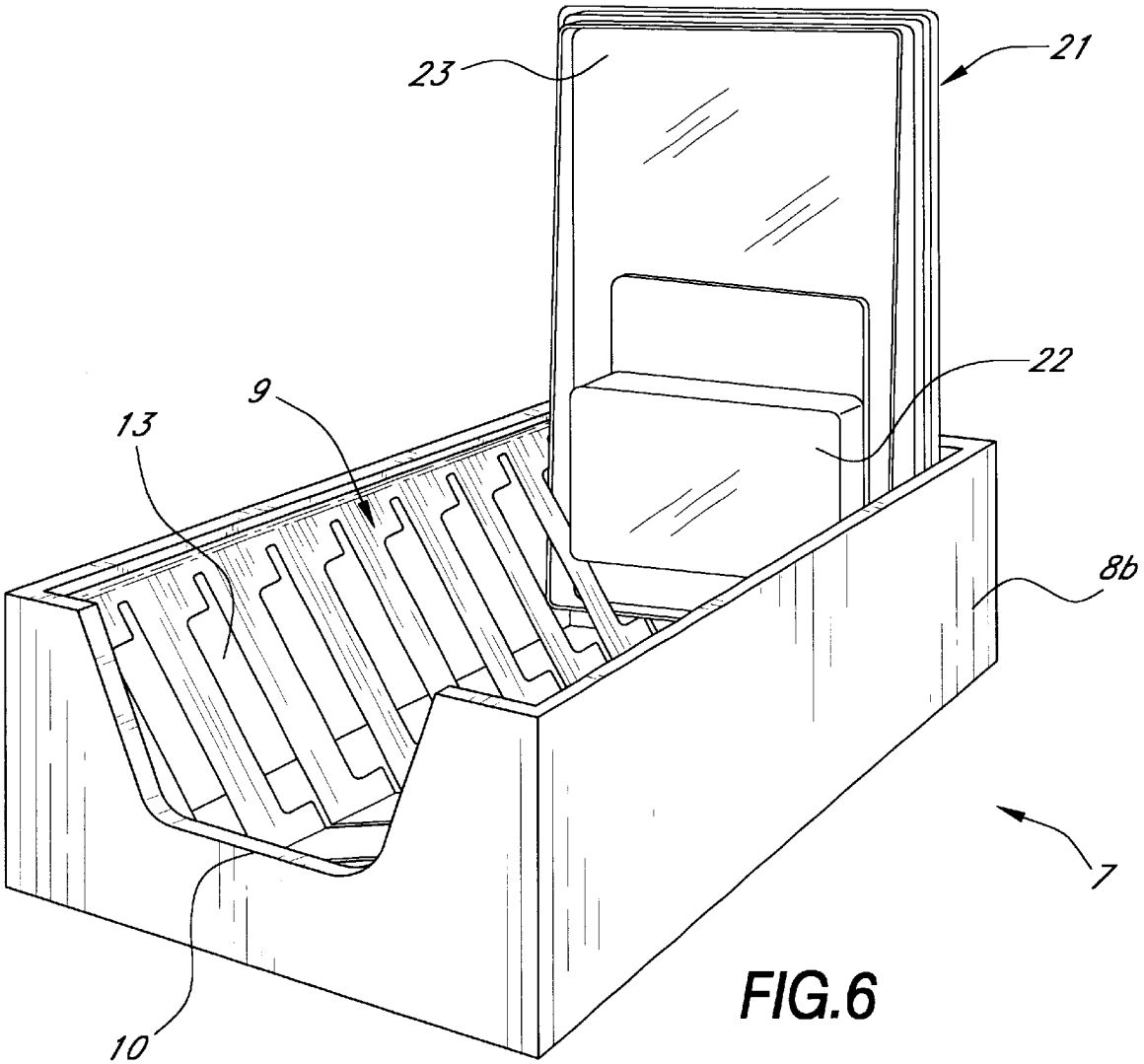
FIG. 6 is a front perspective view of the display tray with a front section removed for better viewing of the packaged product.
Figure 7:
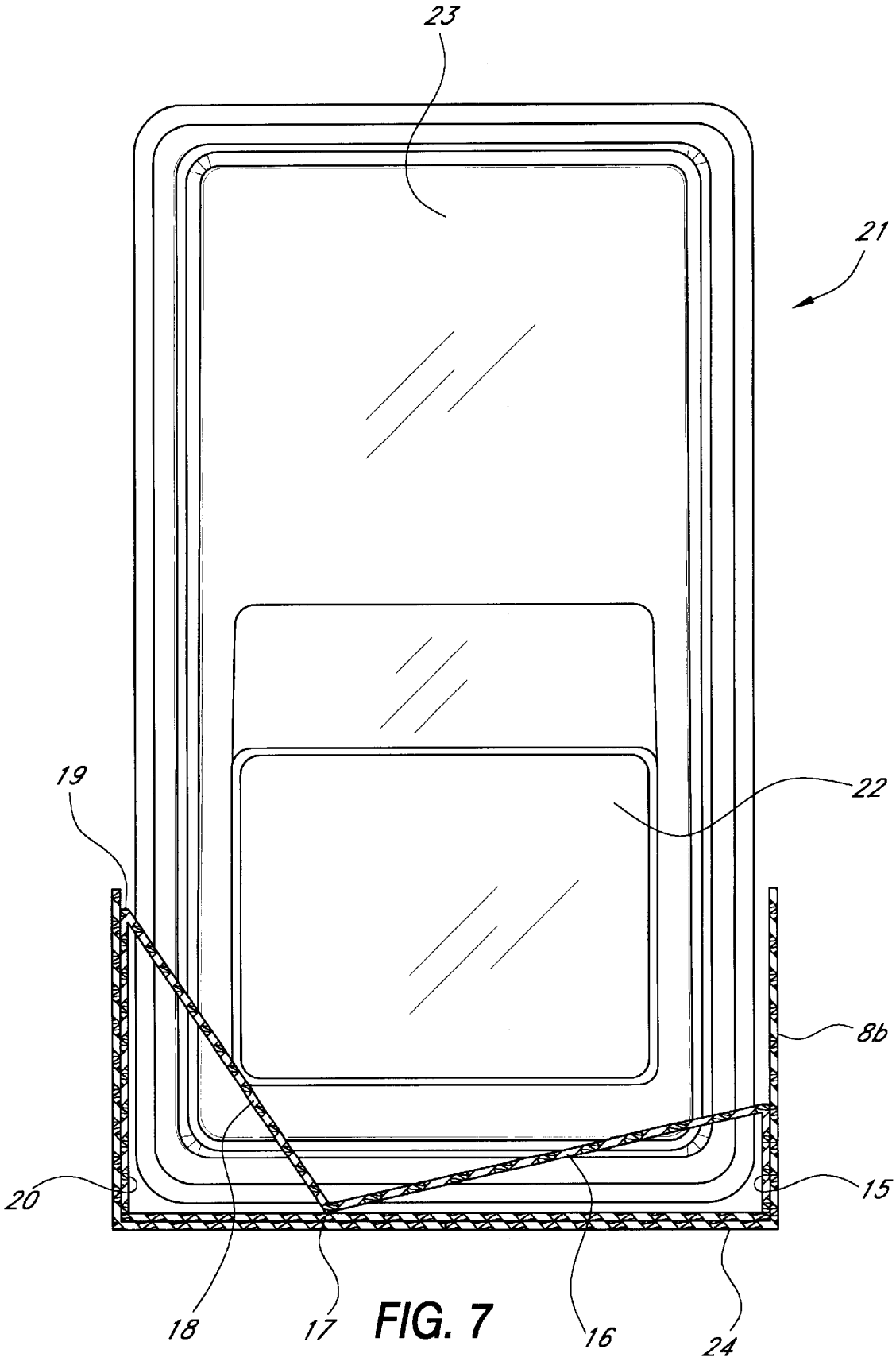
FIG. 7 is a cross sectional view of the tray with a product package in it.

As can be seen from FIGS. 6 and 7, each slot 13 is configured to receive a product package 21 . The package includes an area 22 sized to receive a product and a larger area 23 surrounding the product area 22 and extending between the product and an outer stiff flange 24. The flange fits within the smaller outer edges of the slots 13 to position the packages within the slotted holder 9.

Figure 8:
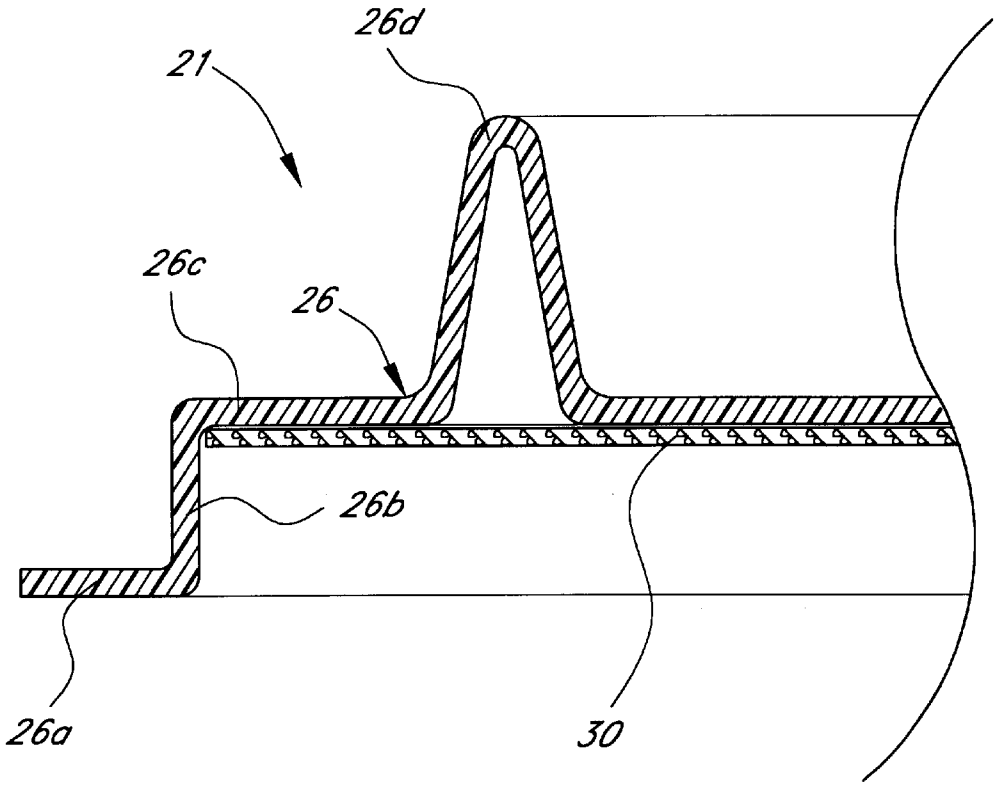
FIG. 8 is a cross-sectional view of an edge portion of the product package.

While a variety of product packages may be employed with the box and tray of the invention, a preferred construction is illustrated in cross-section in FIG. 8. As seen, the package 21 includes a single sheet of thin but stiff plastic 26 which is preferably transparent, to permit viewing of the product captured within the package 21. The sheet 26 includes a short outer horizontal flange 26*a* joined to a short outer vertical lip 26*b* which is joined at approximately a right angle to a short horizontal flange 26*c*. These elements extend around the perimeter of the sheet 26. Integrally joined with the inner edge of the flange 26*c* is a frame 26d having a generally inverted U-shape that is joined on its inner edge to the large flat center section 23.

Positioned within the space defined by the vertical lip 26*b* is a flat, thin backing card 30 that covers the entire backside of the plastic sheet 26 except for the lip 26*a*. The backing card 30 engages and is secured to the flange 26*c*. This of course is after the product is captured within the compartment 22. The backing card may be joined to the flange 26*b* by various techniques. In a preferred approach, a styrene based solvent such as methanol, ethanol, ketone or toluene is employed. The selected material is spread between the plastic sheet and the backing card and a pressure of about 100 psi is applied to the adhesive area, together with heat to a temperature of 400 or 500° F., for approximately two seconds. With this approach, the backing card is securely and permanently fastened to the plastic. The card is also bonded to the plastic sheet around the periphery of the product compartment 22.

Overall, the package 21 has many desirable characteristics. The plastic is sufficiently strong that it cannot be manually torn. Similarly, the backing sheet is sufficiently strong that it cannot be simply broken with the fingers while the backing sheet is connected to the plastic. In addition, if a person attempts to peel the backing sheet from the plastic, the bonding between the two components will prevent this. If the outer layer of the backing sheet starts to separate when an attempt is made to pull it loose, a layer of the backing sheet would start to tear away before the bonded area would give way. Consequently, it is very difficult for a thief to break into the package to take the product captured within it.

Further, the package is too large to be easily hidden by a thief in the store. The package is sufficiently strong that boxes containing the packages can be stacked on pallets. In addition, the products are attractively displayed by the packages when positioned in the tray.

Figure 9:
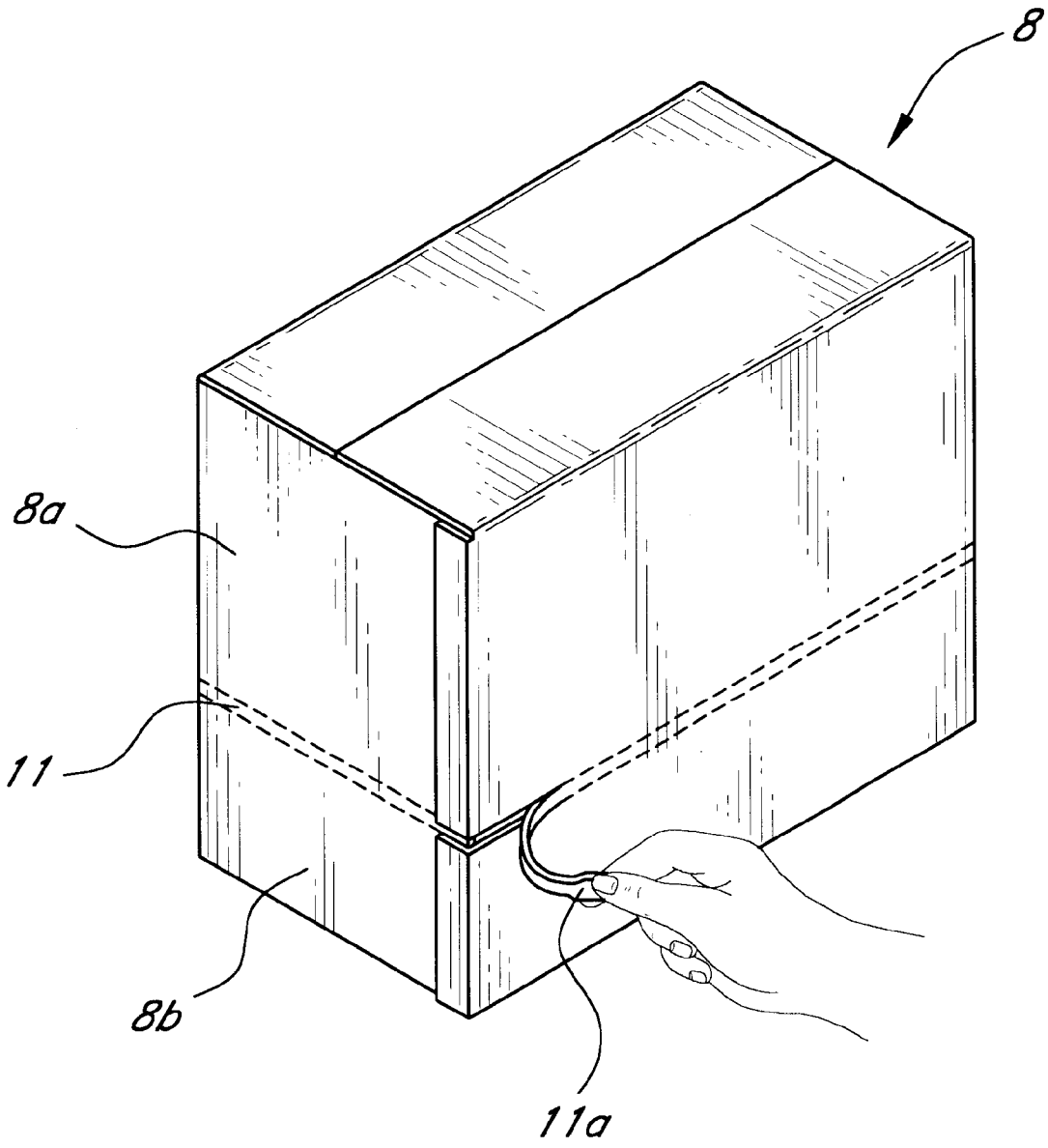
FIG. 9 is a schematic view illustrating the tear strip being removed.
Figure 10:
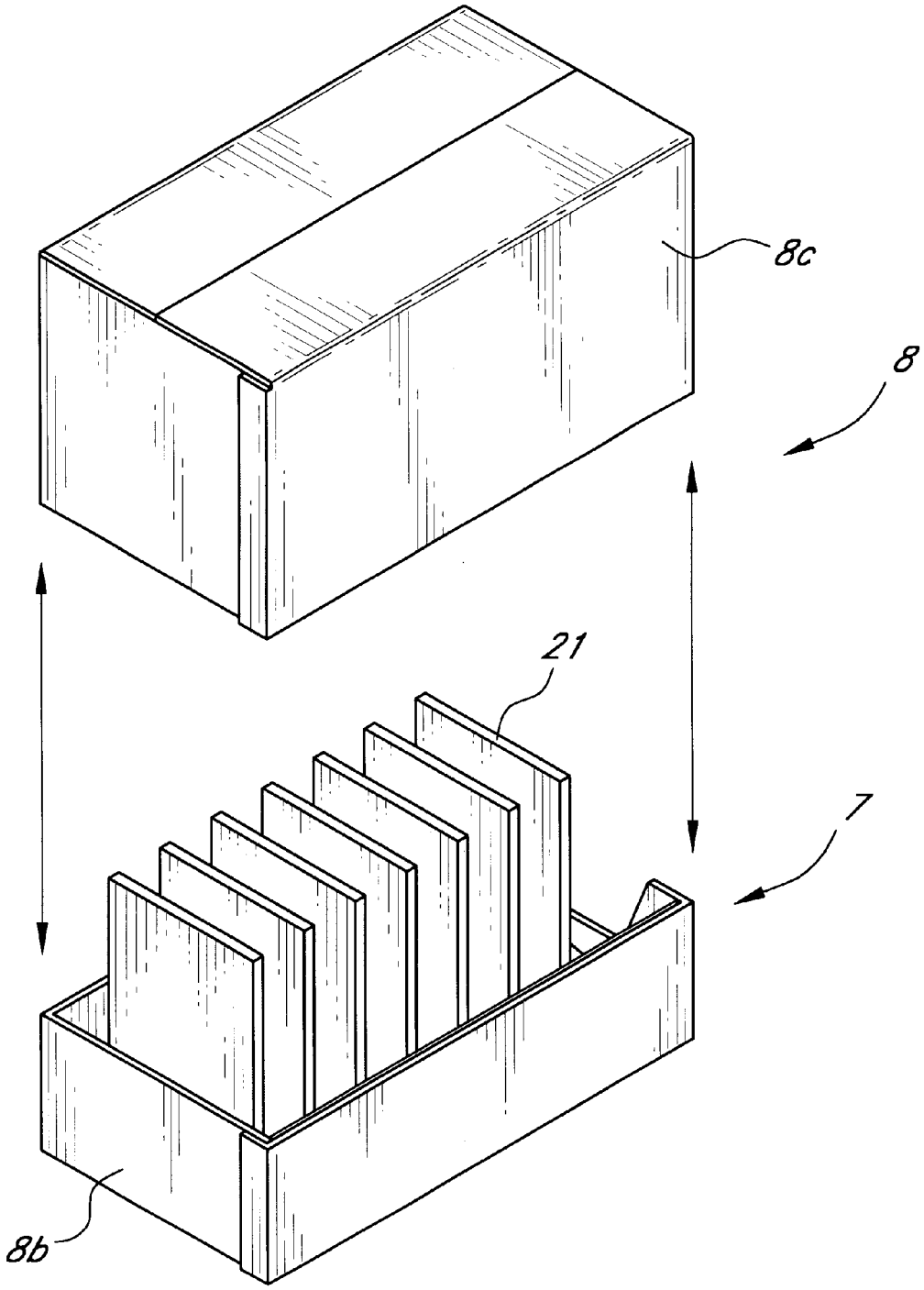
FIG. 10 is a schematic view illustrating the upper portion of the box being removed from the lower portion.

By way of summary, after the box 8 is formed as described above, the slotted holder 9 is positioned within it. The product to be sold is packaged within the large product package 21, and the packages are positioned within the slots of the tray 7. The flaps of the box are then closed and sealed in some suitable fashion. When the box is shipped to the retail store and the contents are to be displayed, it is only necessary to grasp the tear strip tab 11*a*, as illustrated in FIG. 9, and remove the tear strip 11 so that the upper portion 8*c* of the box can be removed, as shown in FIG. 10. This leaves the lower portion 8*b* of the box functioning as the display tray 7. The panel 10 is also removed at that time to enable more complete viewing of the product within the package.

This form of box construction is very advantageous since the lower portion 8*b* of the sidewalls of the box efficiently function as a portion of the wall of the box as well as the sidewalls of the tray 7. This is in contrast to products on the market that have a box cover that completely covers the side walls of the tray, thus requiring additional material. Likewise, the product package 21 is particularly efficient and desirable because only a single sheet of plastic is required.

Another advantage of the box concerns the printing of information on it. Normally, it is desired that the product and its manufacturer or retailer be displayed on the exterior of the box. Also, UPC codes are frequently desired for inventory purposes. It is also desirable that this information be on the tray. With boxes employing an outer shell as well as a separate tray, this printing must be on both items. However, with the box and tray of the invention, it is only necessary to put the printing on the lower portion of the box since that remains as the separated tray.

While a particular form of the invention has been described, it is apparent that many modifications can be made without departing from its essential purpose. Accordingly, the invention tend to be limited in scope by the examples illustrated, and is defined with reference to the following claims.

What is claimed is:

1. An assembly for shipping and-displaying-products comprising:

a shipping box having a top, bottom and side walls, said side walls having a removable strip extending around the side walls of the box that enable the upper portion of the box to be removed by removing the strip, and thereby leaving the lower portion of the box as a display tray with the lower portions of said side walls and said bottom wall forming walls of the tray, said tray being configured to support product packages in the tray in a manner to be readily viewed and accessible by a purchaser; and a holder in the tray for holding said packages in a position convenient for purchasers to remove a package from the tray, said holder including a plurality of slots for receiving stiff edges of the packages toehold the package upright in the tray, said holder having a first slotted section having a first edge adjacent a first side of the tray at a level spaced upwardly from the bottom of the tray, said first section extending downwardly from a first side of the tray towards the bottom of the tray and toward a second side of the tray spaced from the first side, said holder further having a second slotted section having a first edge adjacent the second side of the tray and spaced upwardly from the bottom of the tray, said second section extending from said second side of the tray toward the bottom of the tray and toward the first side of the tray, said sections intersecting in a line closer to the first side of the box than the second side of the box, said sections forming a slot that extends from the upper surfaces of the sections to the bottom of the box.

2. The assembly of claim 1, wherein the first edge of the first section is spaced further above the bottom of the tray than the first edge of the second section which is adjacent.

3. The assembly of claim 1, wherein said tray has a front wall with a central portion which is vertically shorter than the back wall of the tray, and said holder sections form planes that do not intersect the upper edge of a front wall of the tray.

4. The assembly of claim 1, wherein each of said slotted sections is configured to receive a product package having a stiff outer edge and an interior compartment containing a product considerably smaller than the package.

5. The assembly of claim 4, wherein each of said slotted sections is configured to receive a product package which includes a plastic cover and stiff backing sealed to each other.

6. The assembly of claim 5, wherein each of said slotted sections is configured to receive a product package which has a tri-level outer flange in which the front of the flange is tapered in a narrowing fashion from the base of the package to its top, and the back of the flange is approximately planar.

7. The assembly of claim 4 wherein each of said slotted sections is configured to receive a product package which contains a large, thin, outer plastic frame with a smaller interior compartment in which to hold a desired product.

8. An assembly for shipping and displaying products comprising:

a shipping box having a top, bottom and side walls, said side walls having a removable strip extending around the side walls of the box that enable the upper portion of the box to be removed by removing the tear strip, and thereby leaving the lower portion of the box as a display tray with the lower portions of said side walls and said bottom forming walls of the tray, said tray being configured to support product packages in the tray in a manner to be readily viewed and accessible by a purchaser; and a holder in the tray for holding said packages in a position convenient for purchasers to remove a package from the tray, said holder being formed from a single sheet of stiff material folded along three spaced parallel lines to create two spaced side legs and two central slotted sections, said legs being configured to fit within said tray adjacent said tray side walls, with said slotted sections extending downwardly and inwardly to form a plurality of spaced slots extending across the tray and configured to receive stiff edges of said packages to hold the packages upright in the tray.

* * * * *